US006082496A

United States Patent [19]

Bovis et al.

[11] Patent Number: 6,082,496

[45] Date of Patent: Jul. 4, 2000

[54] STAIRLIFT SKATE

[76] Inventors: John Edric Bovis, 3 Joys Lane, Chilbolton, Stockbridge, Hampshire, SO20 6BB; Andreas Csaba Szentistvany, 3 Woodcote Avenue, Wallingford, Surrey, SM6 0QR, both of United Kingdom

[21] Appl. No.: 09/171,557

[22] PCT Filed: Apr. 20, 1996

[86] PCT No.: PCT/GB97/00747

§ 371 Date: Nov. 19, 1998

§ 102(e) Date: Nov. 30, 1998

[87] PCT Pub. No.: WO97/39972

PCT Pub. Date: Oct. 30, 1997

[51] Int. Cl.[7] ..... B66B 9/08

[52] U.S. Cl. ..... 187/201; 187/200; 105/149

[58] Field of Search ..... 187/200, 201, 187/202, 245, 410; 104/130, 55, 56, 63, 64; 105/30, 149, 149.1, 149.2

[56] References Cited

U.S. PATENT DOCUMENTS

| | | | |
|---|---|---|---|
| 4,335,805 | 6/1982 | Grass | 187/201 |
| 5,119,734 | 6/1992 | Schwarzkopf | 104/63 X |
| 5,572,930 | 11/1996 | Hein | 105/30 X |
| 5,709,154 | 1/1998 | Schott | 187/201 |
| 5,967,265 | 10/1999 | Bruno et al. | 187/201 |

FOREIGN PATENT DOCUMENTS

| | | | |
|---|---|---|---|
| 0137577 | 4/1985 | European Pat. Off. . | |
| 0143737 | 6/1985 | European Pat. Off. . | |
| 317782 | 5/1989 | European Pat. Off. | 187/245 |
| 2701981 | 7/1978 | Germany . | |
| 3604094 | 4/1987 | Germany | 187/201 |
| 2157653 | 10/1985 | United Kingdom | 187/201 |
| WO 92/14673 | 10/1985 | WIPO | 187/245 |
| 9529867 | 11/1995 | WIPO . | |

*Primary Examiner*—Robert P. Olszewski
*Assistant Examiner*—Thuy V. Tran
*Attorney, Agent, or Firm*—Edwin D. Schindler

[57] ABSTRACT

A skate for a stairlift chair assembly (10) comprises two spaced-apart pairs of rollers, the two rollers (e.g., 27, 28) of each pair being arranged to run respectively above and below a circular section support rail (12) of the stairlift. The two rollers of each pair are rotatable about respective axes (C, D) transverse of the skate, and each roller is able to turn about a further axis (E) which intersects and is orthogonal to the rotary axes (C, D) of the pair of rollers. Each roller is constrained so that its rotary axis (C or D) remains substantially in a plane to which said further axis (E) is perpendicular.

7 Claims, 4 Drawing Sheets

STAIRLIFT SKATE

The present invention relates to stairlifts and more particularly to a skate for supporting a chair assembly on and guiding it along a stairlift rail.

Stairlifts comprise a rail mounted along a flight of stairs, and a motorised chair assembly for travelling along that rail. The chair assembly is supported on the rail by means of a carriage or skate mounted to the chair assembly, and typically comprising two spaced-apart sets of rollers. A known stairlift comprises a flat rail on which the rollers run, and each set of rollers is able to turn to follow variations in the inclination of the rail and also to follow curves formed in the rail according to changes in direction of the stairway.

However, a preferred form of rail is a tubular rail of circular cross-section, which is stronger than a similarly-dimensioned flat rail and can be formed to a smaller bend radius.

We have now devised a skate for the chair assembly of a stairlift, in which a tubular support rail is used, the skate being able to follow curves in that rail.

In accordance with the present invention, there is provided a skate for a stairlift chair assembly, the skate comprising two spaced-apart pairs of rollers, the two rollers of each pair being arranged to run respectively above and below a circular-section support rail of the stairlift, the two rollers of each pair being rotatable about respective axes transverse of the skate, and each roller being able to turn about a further axis which intersects and is orthogonal to the rotary axes of the pair of rollers, but being constrained so that its rotary axis remains substantially in a plane to which said further axis is perpendicular.

In use of this skate, each pair of rollers is able to turn, about said further axis or axis of turning, to follow curves in the support rail. However, the rotary axes of the rollers remain substantially in respective planes, so that one roller of each pair continues to run on the upper side of the rail, and the other roller of that pair runs on the lower side of the rail: this ensures a firm support for the chair assembly at all times. In particular, it will be appreciated that the rotary axes of the two rollers of each pair remain in respective planes which are parallel to each other, said axis of turning being perpendicular to those planes: in other words, the rollers do not displace around the longitudinal axis of the main rail.

Each roller may have bearing elements at its opposite ends (e.g. ball bearings engaged in respective depressions at its opposite ends), these bearing elements being engaged in arcuate slots of opposed bearing supports. These bearing elements thus provide for the roller to rotate on its rotary axis, and the bearing elements can slide within their respective arcuate slots for the roller to turn on said axis of turning.

In an alternative arrangement, each roller is rotatably mounted on an axle, the opposite ends of which are fitted with cross-pieces having arcuate outer end surfaces, these cross-pieces being engaged in arcuate slots of opposed bearing supports.

Preferably the two pairs of rollers are mounted to respective roller housings, and the roller housings are mounted for turning about respective parallel, horizontal axes spaced apart longitudinally of the skate. Each roller housing is thus able to turn and follow the support rail, as the inclination of the support rail changes.

Also in the embodiments to be described herein, the axis of one of the roller housings is fixed, and the other roller housing is mounted on a support which is able to turn about the axis of the one roller housing: the skate is therefore able to follow variations in the inclination of the support rail whilst maintaining the chair assembly upright.

Embodiments of the present invention will now be described by way of examples only and with reference to the accompanying drawings, in which.

Figure 1:
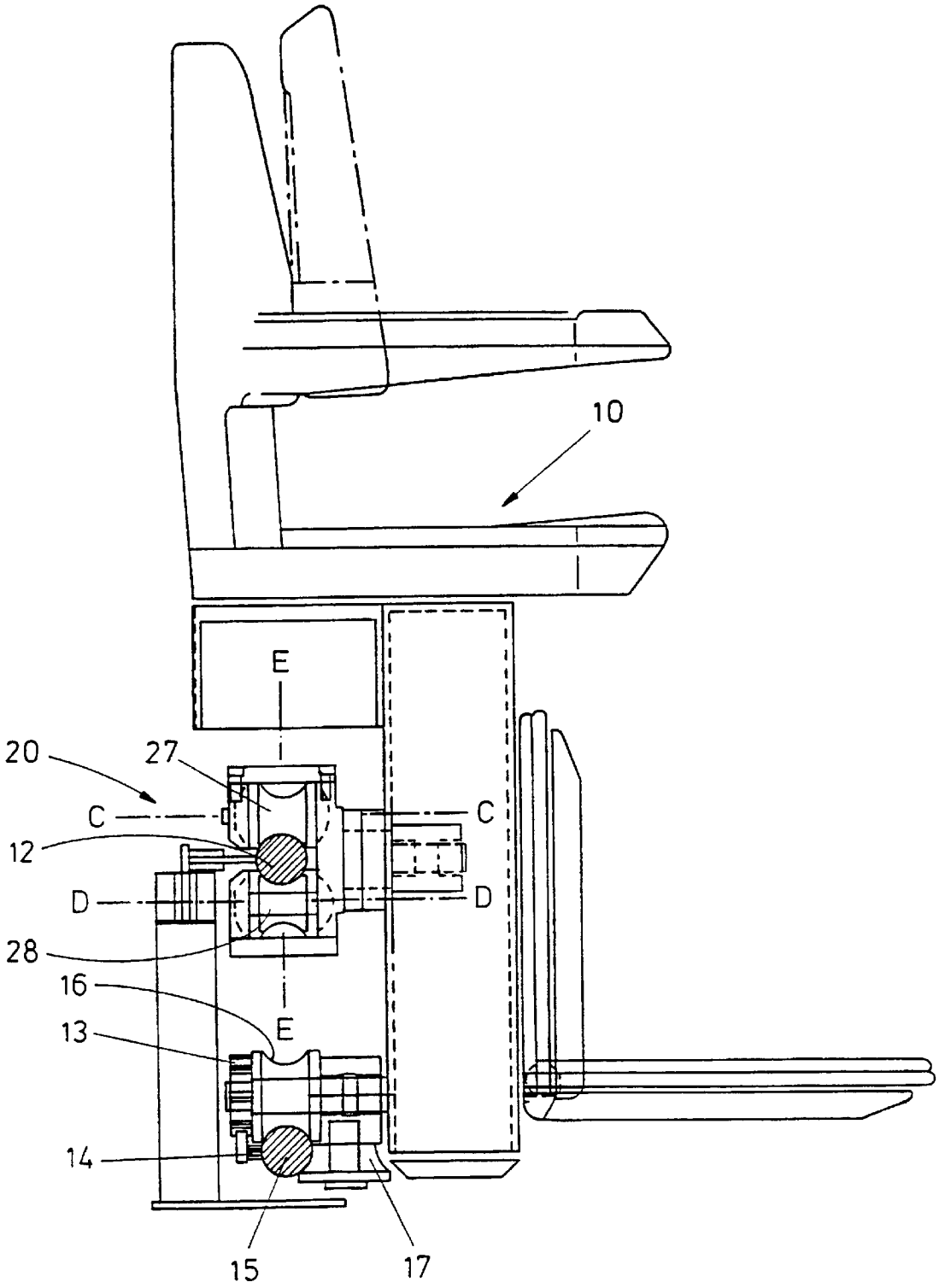
FIG. 1 is a side elevation of a chair assembly of a stairlift, shown mounted on its support rails.

Referring to FIG. 1, there is shown a stairlift comprising a chair assembly 10 supported on and guided along a main tubular rail 12 of circular cross-section, by means of a skate 20 which will be described in detail below. The chair assembly 10 is propelled by an electric motor (not shown) which drives a toothed wheel 13 engaged with a corresponding rack 14 extending behind a second or auxiliary tubular rail 15. A roller 16 is provided on the motor drive shaft and runs on the upper side of the second rail 15 to provide auxiliary support for the chair assembly lo: a further roller 17 runs along the front of the rail 15 to help prevent the chair assembly 10 from tipping forward.

Figure 2:
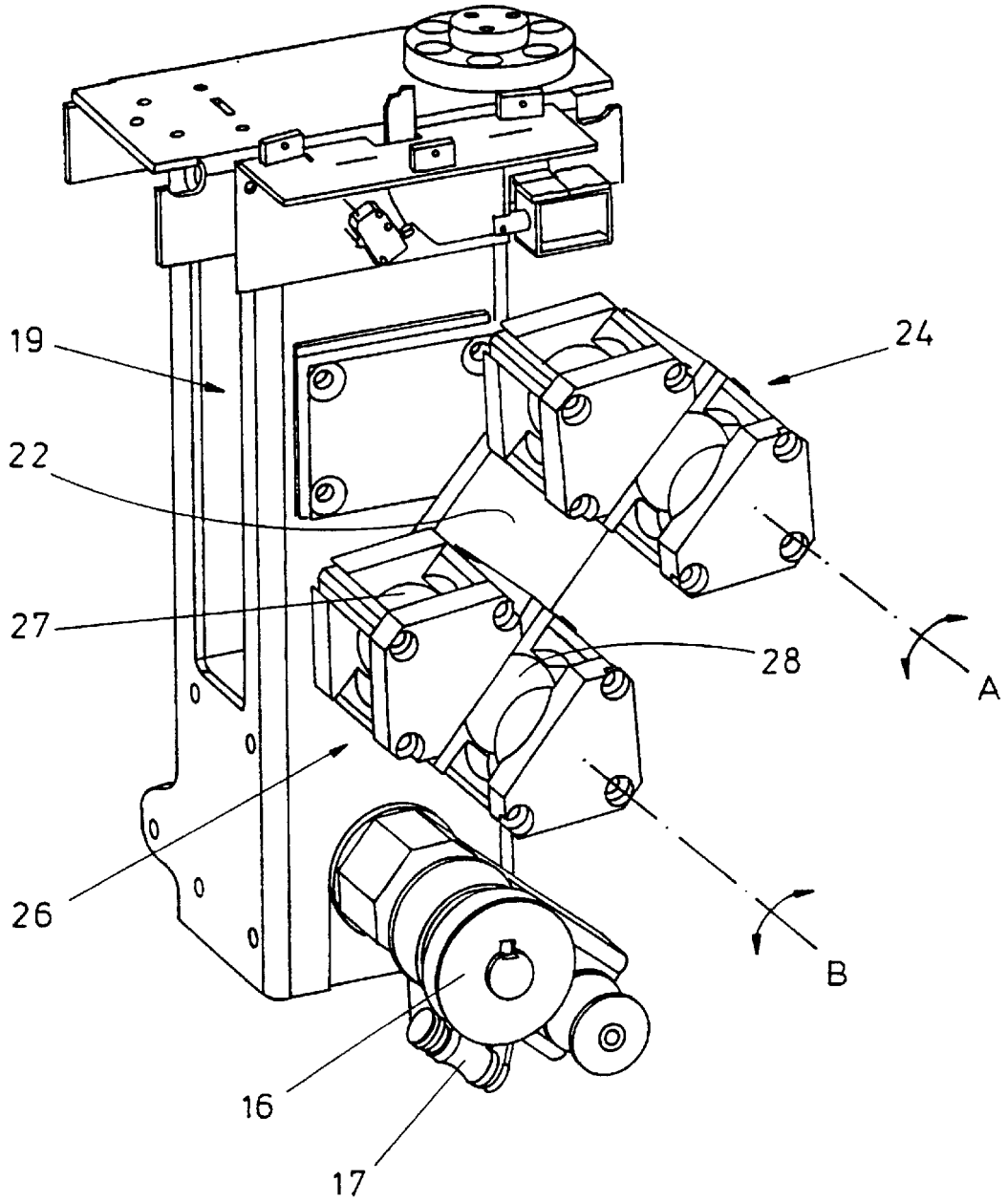
FIG. 2 is a view of a skate mounted to the chair assembly.

Referring to FIG. 2, the skate 20 comprises a support member 22 which is pivotally mounted to the chair chassis 19, for turning about a horizontal, transverse axis A. Two roller housing 24,26 are pivotally mounted to the support member 22, for turning about the axis A and about a parallel axis B, respectively. Two rollers e.g. 27,28 are rotatably mounted in each of the roller housings: as shown in FIG. 1, one roller of each pair runs on the upper side of the tubular rail 12, and the other roller of the pair runs on the lower side of the rail. Each roller has a concave peripheral surface, of radius of curvature corresponding to the cross-section of the rail 12.

Typically a flight of stairs may include landings or other features such that the angle of inclination of the main rail 12 varies along its length. The spacing of the rail 15 from the rail 12 is therefore varied along the length of the stairway to ensure that the chair assembly 10 remains upright at all positions along the stairway: it will be appreciated that there is a constant distance between the point on the main rail 12 at which the upper pair of skate rollers engage that rail, and the point on the lower or auxiliary rail 15 at which the rollers 16,17 engage that rail; thus by appropriately varying the distance of auxiliary rail 15 from the main rail 12 as the inclination of the main rail varies, the chair assembly is maintained upright as it travels along its rails. Further, as the inclination of the main rail 12 varies, the chair assembly remaining upright, the lower roller pair 27,28 follow the rail 12 and the support member 22 of the skate correspondingly turns around the axis A. It will further be appreciated that as the inclination of the main rail 12 changes, each of the two pairs of skate rollers can independently follow those changes, their housings 24,26 independently turning about their respective axes A, B.

Figure 3:
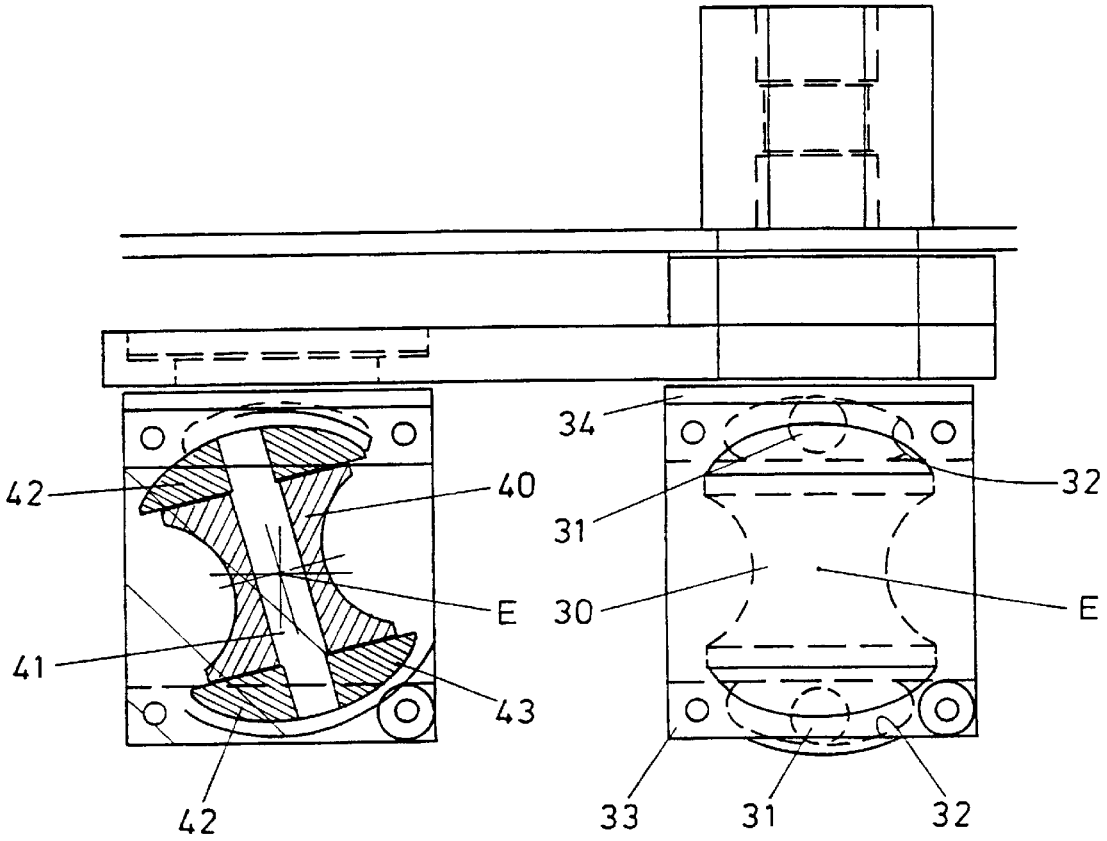
FIG. 3 is a sectional plan view of the skate, showing alternative arrangements for mounting the skate rollers.

Typically the stairway will include changes in direction or other features, such that the main rail 12 will include curved portions to follow those changes. The skate rollers are able to pivot, as shown in FIG. 3, to follow such curves in the main rail 12. As shown in FIG. 1, the rollers of each pair are mounted for rotation around respective axes C, D which extend transverse to the skate (and normally horizontally): in order to follow curves in the main rail 12, the rollers are able to turn about an axis E which is orthogonal to and intersects both roller axes C, D. However, the rollers are constrained so that their rotary axes C, D remain substantially in respective parallel planes, to which the axis E is perpendicular: axis E lies in a vertical plane containing the axis of the main rail 12 and is perpendicular to the latter axis.

Referring to FIG. 3, this arrangement may be achieved using one-piece rollers, each roller e.g. 30 having a part-spherical depression in its opposite ends, receiving respective ball bearings 31: these ball bearings are in turn engaged in arcuate slots 32 in opposed bearing supports 33,34 of the respective roller housing. The depressions receiving the ball bearings 30 are aligned on the rotary axis of the roller, such that the ball bearings 31 provide bearings for the roller to rotate on its axis. The ball bearings 31 are able to slide within the arcuate slots 32 and so allow the roller to turn on the axis E through a limited angle, to follow curves in the main rail 12: however, it will be appreciated that the axis of rotation of the roller is maintained within a plane to which axis E is perpendicular.

Figure 4:
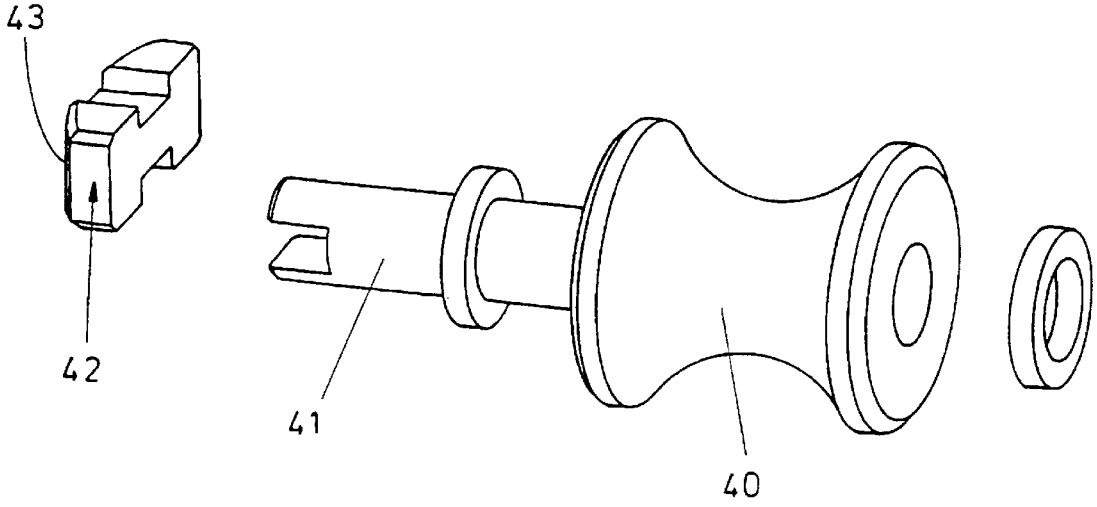
FIG. 4 is an exploded view of one of the rollers.

Also as shown in FIG. 3, in an alternative arrangement, each roller e.g. 40 is rotatably mounted on an axle 41 having a cross-piece 42 fitted in a transverse slot in each of its opposite ends. As shown in FIG. 4, each cross-piece 42 has flat, parallel opposite side surfaces and an arcuate outer end surface 43. The two members 42 are engaged in arcuate slots in the bearing supports 33,34 of the respective roller housing, to allow the roller to turn through a limited angle about the axis E.

Figure 5:
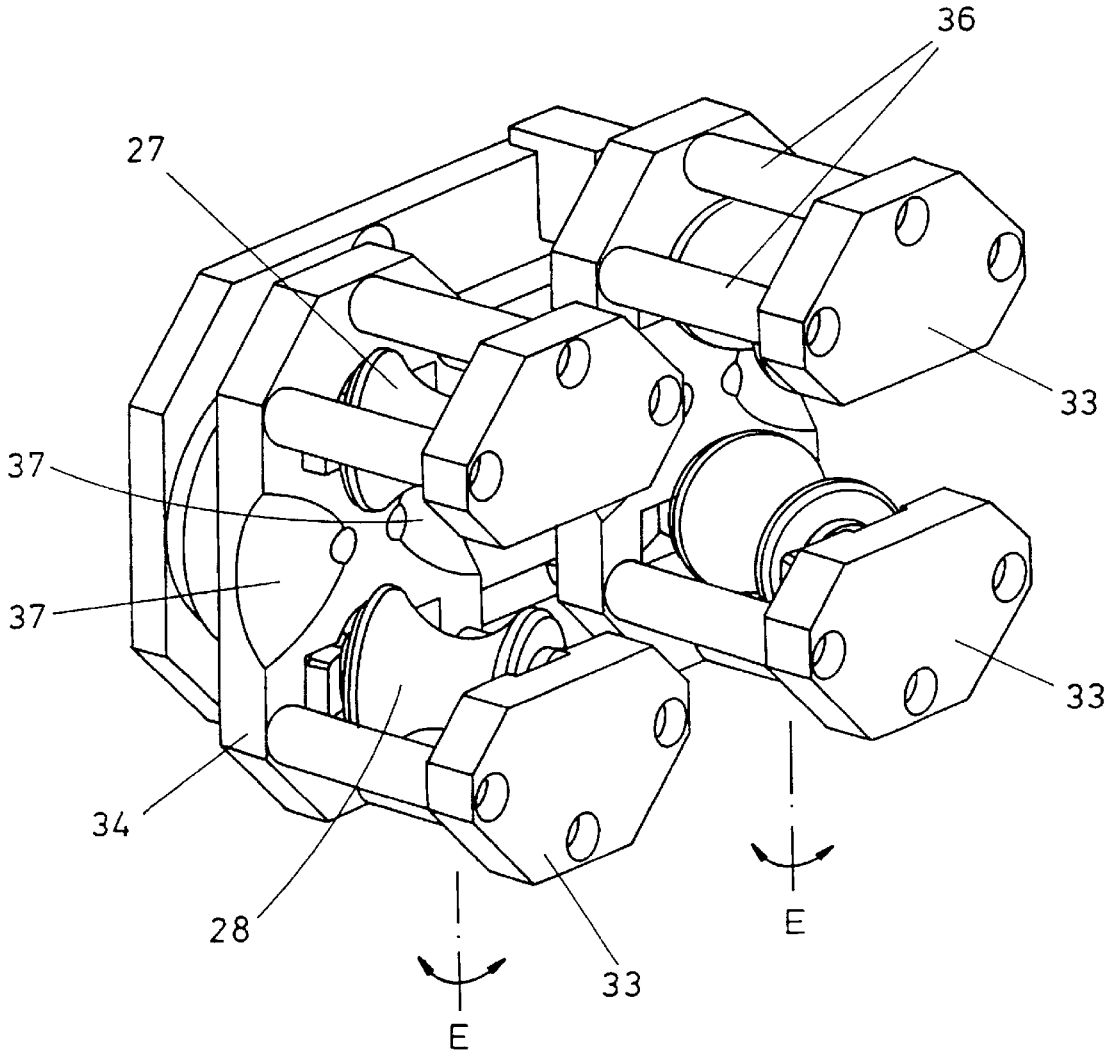
FIG. 5 is another view of the skate.

It will be seen from FIG. 5 in particular that each roller is able independently to turn around the axis E, although in practice the two rollers of each pair will turn in unison around that axis in order to follow the main rail 12. FIG. 5 further shows that each roller housing comprises a base 34 providing a bearing support for both rollers of that pair, and respective bearing supports 33 for the opposite ends of those rollers, the bearing supports 33 being mounted to the base 34 by means of posts 36. It will be noted that the base 34 is cut-away or recessed at 37, to accommodate the main rail 12 where this is tightly curved.

What is claimed is:

1. A skate (20) for a stairlift chair assembly, said skate comprising two spaced-apart pairs of rollers, the two rollers of each pair being arranged to run respectively above and below a support rail of the stairlift, said two rollers of each pair being rotatable about respective axes (C,D) transverse to the moving direction of said skate, and each roller of each pair of rollers having its opposite ends engaged with respective, opposed support members in a manner such that said roller is able to turn, relative to its support members, about a further axis (E) which intersects and is orthogonal to the rotary axes (C,D) of said pair of rollers, but is constrained so that its rotary axis (C or D) remains substantially in a plane to which said further axis (E) is perpendicular.

2. A skate as claimed in claim 1, wherein each roller comprises projecting portions at its opposite ends which engage corresponding arcuate slots formed in said opposed support members.

3. A skate as claimed in claim 2, wherein each roller has bearing elements at its opposite ends, engaged in respective said arcuate slots to provide for rotation of said roller about its axis (C or D) and to enable the roller to turn about said further axis (E).

4. A skate as claimed in claim 3, in which said bearing elements comprise ball bearings engaged in respective depressions at the opposite ends of the respective rollers.

5. A skate as claimed in claim 2, wherein each roller includes an axle, the opposite ends of which are fitted with cross-pieces having arcuate outer end surfaces, said cross-pieces being engaged in respective said arcuate slots to enable said roller to turn about said further axis (E).

6. A skate as claimed in claim 1, wherein said two pairs of rollers are mounted via their respective, opposed support members, to respective roller housings, and said roller housings are mounted for turning about respective parallel, horizontal axes (A,B) spaced apart longitudinally of the skate.

7. A skate as claimed in claim 6, wherein the axis (A) of one of said roller housings is fixed, the other roller housing being mounted on a support which is able to turn about the axis (A) of said one roller housing, (24).

* * * * *